US008474946B2

(12) United States Patent
Izumikawa et al.

(10) Patent No.: US 8,474,946 B2
(45) Date of Patent: Jul. 2, 2013

(54) IMAGE FORMING APPARATUS AND FOAM APPLICATION DEVICE

(75) Inventors: Manabu Izumikawa, Tokyo (JP); Kazuyoshi Matsumoto, Tokyo (JP); Minori Ichimura, Tokyo (JP); Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 162 days.

(21) Appl. No.: 12/991,331

(22) PCT Filed: May 14, 2009

(86) PCT No.: PCT/JP2009/059306

§ 371 (c)(1),
(2), (4) Date: Nov. 5, 2010

(87) PCT Pub. No.: WO2009/142252

PCT Pub. Date: Nov. 26, 2009

(65) Prior Publication Data

US 2011/0057988 A1 Mar. 10, 2011

(30) Foreign Application Priority Data

May 23, 2008 (JP) ..... 2008-134907
Jan. 24, 2009 (JP) ..... 2009-013727

(51) Int. Cl.
*B41J 2/165* (2006.01)

(52) U.S. Cl.
USPC ..... 347/21

(58) Field of Classification Search
None
See application file for complete search history.

(56) References Cited

U.S. PATENT DOCUMENTS

| | | | | |
|---|---|---|---|---|
| 5,771,054 | A | 6/1998 | Dudek et al. | |
| 7,046,952 | B2 * | 5/2006 | Kurotori et al. | 399/340 |
| 7,434,927 | B2 | 10/2008 | Sakuma et al. | |
| 7,591,551 | B2 | 9/2009 | Imoto et al. | |
| 7,621,632 | B2 | 11/2009 | Imoto et al. | |
| 7,663,658 | B2 | 2/2010 | Murano et al. | |
| 7,682,016 | B2 | 3/2010 | Sakuma et al. | |
| 7,731,322 | B2 | 6/2010 | Kogure et al. | |
| 7,813,669 | B2 | 10/2010 | Matsumoto et al. | |

(Continued)

FOREIGN PATENT DOCUMENTS

| | | |
|---|---|---|
| JP | 59-69179 | 4/1984 |
| JP | 8-323977 | 12/1996 |

(Continued)

OTHER PUBLICATIONS

International Search Report in PCT/JP2009/059306.

*Primary Examiner* — Matthew Luu
*Assistant Examiner* — Alejandro Valencia
(74) *Attorney, Agent, or Firm* — Cooper & Dunham LLP

(57) ABSTRACT

An image forming apparatus is disclosed that includes an image forming unit that forms an image on a medium to be recorded; and a foam application unit that applies a foam generated from at least any one of a liquid and a gel to the medium to be recorded or an intermediate member for applying the foam to the medium to be recorded. The foam application unit has a foam generation unit that generates the foam, an application unit that applies the generated foam to the medium to be recorded or the intermediate member, a foam supplying path through which the generated foam is supplied to the application unit, and a unit that increases a volume of the foam supplying path. The foam application unit increases the volume of the foam supplying path when stopping the supply of the foam to the application unit.

7 Claims, 14 Drawing Sheets

U.S. PATENT DOCUMENTS

| | | | | |
|---|---|---|---|---|
| 2004/0204535 | A1 | 10/2004 | Confalone et al. | |
| 2006/0057339 | A1 | 3/2006 | Adachi et al. | |
| 2008/0043083 | A1 | 2/2008 | Imoto et al. | |
| 2008/0074479 | A1 * | 3/2008 | Santos et al. | 347/85 |
| 2008/0145123 | A1 | 6/2008 | Kogure et al. | |
| 2008/0316279 | A1 | 12/2008 | Takemoto et al. | |
| 2009/0052917 | A1 | 2/2009 | Kogure et al. | |
| 2009/0073211 | A1 | 3/2009 | Imoto | |
| 2009/0074461 | A1 | 3/2009 | Imoto | |
| 2009/0102908 | A1 | 4/2009 | Imoto | |
| 2009/0151625 | A1 | 6/2009 | Matsumoto et al. | |
| 2010/0165016 | A1 | 7/2010 | Ichimura et al. | |

FOREIGN PATENT DOCUMENTS

| | | |
|---|---|---|
| JP | 11-156270 | 6/1999 |
| JP | 2000-126664 | 5/2000 |
| JP | 2002-137378 | 5/2002 |
| JP | 2003-205673 | 7/2003 |
| JP | 2005-138502 | 6/2005 |
| JP | 2007-301816 | 11/2007 |

* cited by examiner

IMAGE FORMING APPARATUS AND FOAM APPLICATION DEVICE

TECHNICAL FIELD

The present invention relates to an image forming apparatus and a foam application device.

BACKGROUND ART

As image forming apparatuses such as printers, facsimile machines, copiers, plotters, and multi-task machines having plural such functions, ink jet recording apparatuses of a liquid ejection recording type using a recording head that ejects, for example, ink liquid droplets are known. The image forming apparatus of this type ejects ink droplets from the recording head onto a sheet (that is not limited to a paper, but it means one such as an overhead transparency film to which ink droplets and other liquids can be attached and referred to be a medium to be recorded, a recording paper, or a recording sheet) during conveyance to perform image formation (used synonymously with recording, printing, and imaging). Examples of the image forming apparatus include a serial-type image forming apparatus in which the recording head ejects liquid droplets to form an image while moving in a main scanning direction and a line-type image forming apparatus using a line-type head in which the recording head ejects liquid droplets to form an image without moving.

Note that in the present invention, the "image forming apparatus" of the liquid ejection recording type refers to an apparatus that ejects a liquid onto a medium such as a paper, a thread, a fiber, a fabric, leather, metal, a plastic, glass, wood, and a ceramic so as to perform the image formation. Furthermore, the "image formation" refers to forming on the medium not only relevant images such as characters and graphics, but also irrelevant images such as patterns (i.e., liquid droplets are just ejected on the medium). Furthermore, "ink" is not limited to narrowly-defined ink and is not particularly limited so long as it is turned into a liquid when being ejected. For example, the ink refers also to a DNA sample, a resist material, a pattern material, etc.

In the above image forming apparatus, the ink containing a color material is turned into liquid droplets to perform the image formation. Therefore, there arises problems such as "feathering" in which dots formed by the liquid droplets are disordered in the shape of whiskers and "color bleed" in which different colors of ink droplets are mixed together to make a color border unclear when they are adjacently ejected on a sheet. In addition, it takes time to dry the liquid droplets ejected on the sheet.

In order to deal with the above problems, as described in Patent Document 1, a heating unit is used before or after the ejection of liquid droplets so as to prevent feathering and accelerate the drying of ink.

Furthermore, as described in Patent Document 2, a pretreatment liquid that reacts with ink to prevent feathering is applied with an application roller. Also, as described in Patent Document 3, the pretreatment liquid is ejected from the liquid ejection head in mist form and applied.

Patent Document 1: JP-A-8-323977
Patent Document 2: JP-A-2002-137378
Patent Document 3: JP-A-2005-138502

However, when the heating unit is provided as described in Patent Document 1, the power consumption of an apparatus becomes large. Furthermore, when the pretreatment liquid is applied with the application roller and the liquid ejection head as described in Patent Documents 2 and 3, irregularities in the application of the pretreatment liquid are caused. In addition, since the liquid is excessively applied onto the sheet, the quick-drying property of the sheet after reacting with the ink is degraded. Particularly, the sheet is likely to be curled and deflected, which results in occurrence of jamming, etc.

DISCLOSURE OF INVENTION

The present invention has been made in light of the above problems and may have an object of applying a foamed liquid or a gel or both the foamed liquid and the gel with an even thickness. Also, the present invention may have an object of preventing the application of the foam to an unnecessary part when the liquid or the gel is or both the liquid and the gel are foamed with air.

According to an aspect of the present invention, there is provided an image forming apparatus including an image forming unit that forms an image on a medium to be recorded; and a foam application unit that applies a foam generated from at least any one of a liquid and a gel to the medium to be recorded or an intermediate member for applying the foam to the medium to be recorded. The foam application unit has a foam generation unit that generates the foam, an application unit that applies the generated foam to the medium to be recorded or the intermediate member, a foam supplying path through which the generated foam is supplied to the application unit, and a unit that increases a volume of the foam supplying path. The foam application unit increases the volume of the foam supplying path when stopping the supply of the foam to the application unit.

According to another aspect of the present invention, there is provided an image forming apparatus including an image forming unit that forms an image on a medium to be recorded; and a foam application unit that applies a foam generated from at least any one of a liquid and a gel to the medium to be recorded or an intermediate member for applying the foam to the medium to be recorded. The foam application unit has a foam generation unit that generates the foam, an application unit that applies the generated foam to the medium to be recorded or the intermediate member, a foam supplying path through which the generated foam is supplied to the application unit, a returning path that is branched from the foam supplying path and through which the foam is returned to the foam generation unit or a unit that supplies at least any one of the liquid and the gel to the foam generation unit, and an opening/closing unit that opens and closes the returning path. The foam application unit closes the opening/closing unit when supplying the foam to the application unit and opens the opening/closing unit when stopping the supply of the foam to the application unit.

According to still another aspect of the present invention, there is provided a foam application device that applies a foam generated from at least any one of a liquid and a gel to a member to be applied. The foam application device includes a foam generation unit that generates the foam; an application unit that applies the generated foam to the member to be applied; a foam supplying path through which the generated foam is supplied to the application unit; and a unit that increases a volume of the foam supplying path. The foam application device increases the volume of the foam supplying path when stopping the supply of the foam to the application unit.

Note that the "foam" in the embodiments of the present invention refers to a rounded matter generated when a liquid absorbs gas such as air; the foam is shaped by the surface tension of the liquid covering the gas, and can maintain its three-dimensional shape for a certain period. The foam having such a shape retention capability preferably has a bulk density of 0.05 g/cm$^3$ or lower, a diameter in the range of 10 μm through 1 mm, and an average diameter of 100 μm or smaller. The independent foam is rounded but becomes polyhedral due to its surface tension when a lot of foam is bonded together. Furthermore, the "gel" in the embodiment of the present invention refers to solidified semi-solid matter generated when a colloidal solution and a high polymer compound dispersed in a dispersion medium lose independent mobility due to their mutual actions and particles are linked to each other to have a net-like or honeycomb-like structure. In addition, the "expanding" in the embodiment of the present invention refers to expanding and developing the foam.

BEST MODE FOR CARRYING OUT THE INVENTION

Figure 1:
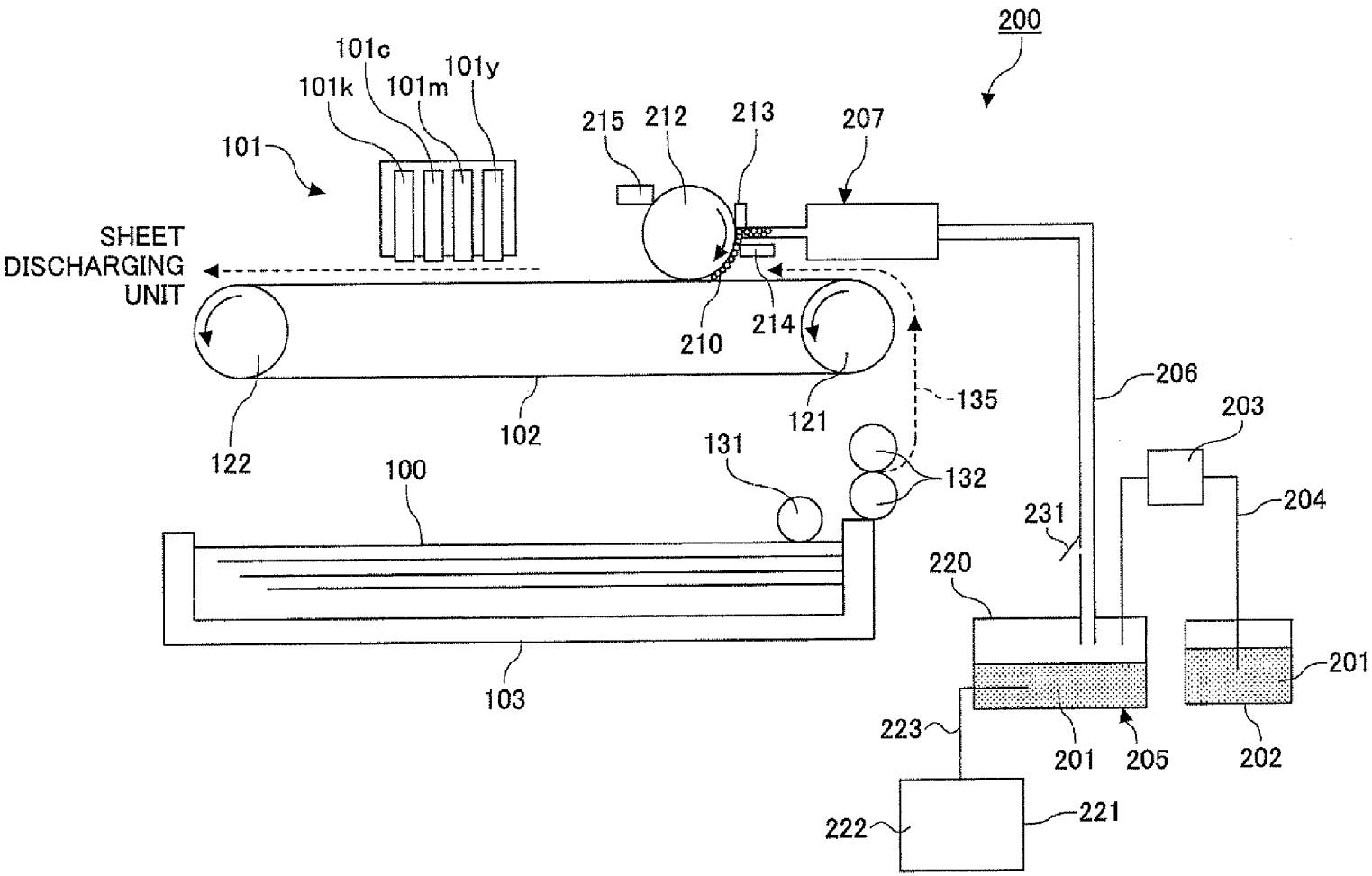
FIG. 1 is the entire configuration diagram of an image forming apparatus having a foam application device according to a first embodiment of the present invention.

Referring to the accompanying drawings, a description is now made of the embodiments of the present invention. First, an example of an image forming apparatus having a foam application device according to a first embodiment of the present invention is described based on FIG. 1. Note that FIG. 1 is the entire configuration diagram of the image forming apparatus.

The image forming apparatus has a recording head unit 101 as an image forming unit that ejects liquid droplets to a sheet 100 as a medium to be recorded to form an image; a conveyance belt 102 that conveys the sheet 100; a sheet feeding tray 103 that accommodates the sheet 100; and a foam application device 200 (device that applies foam to a member to be applied) according to the embodiments of the present invention that applies foam to the sheet 100 as the member to be applied on the upstream side of the recording head unit 101 in a sheet conveyance direction.

The recording head unit 101 is composed of a line-type liquid ejection head having nozzle arrays consisting of plural nozzles for ejecting liquid droplets and arranged so as to correspond to the length of the sheet. The recording head unit 101 has recording heads 101*y*, 101*m*, 101*c*, and 101*k* accommodating the ink of yellow (Y), magenta (M), cyan (C), and black (K), respectively. Note that a serial-type image forming apparatus may be employed in which the recording head is mounted on a carriage.

The conveyance belt 102 is an endless belt suspended between a conveyance roller 121 and a tension roller 122 to rotate. In order to hold the sheet 100 on the conveyance belt 102, electrostatic attraction, adhesion by air suction, and other known conveyance units can be used.

The sheets 100 accommodated in the sheet feeding tray 103 are separated and fed one by one with a pick-up roller 131, and then they are transferred to and held on the conveyance belt 102 with conveyance rollers 132 and a pair of conveyance rollers not shown through a conveyance path 135.

Then, the foam application device 200 applies foam 210 to the sheet 100 as the member to be applied conveyed by the conveyance belt 102. The foam 210 applied to the sheet 100 is quickly dried, and the respective colors of ink droplets are ejected from the head unit 101 to the sheet 100 to form an image on the sheet 100. After this, the sheet 100 is discharged to the sheet receiving tray of a sheet receiving unit.

On the other hand, the foam application device 200 has a container 202, a pump 203, a foam generation unit 205, a foam supplying unit 207, an application roller 212, a thickness control unit 214, and a cleaning member 215. The container 202 accommodates a liquid or a gel capable of being foamed or both the liquid and the gel (hereinafter referred to as a "processing liquid" or a "setting agent") 201. The pump 203 pumps the processing liquid 201 from the container 202. The foam generation unit 205 generates the foam 210 from the processing liquid 201 supplied through a supplying path 204 with the pump 203. The foam supplying unit 207 expands and supplies the foam 210, which is supplied from the foam generation unit 205 through a foam supplying path 206 as a path for supplying the foam, to the peripheral surface of the application roller 212 as an application unit. The application roller 212 carries the supplied foam 210 on its peripheral surface and serves as an application unit that applies the foam 210 to the sheet 100. The thickness control unit 214 controls the film thickness (thickness of an applied film) of the foam 210 carried on the application roller 212 to a desired thickness. The cleaning member 215 removes the foam 210 left on the peripheral surface of the application roller 212 after the foam 210 is applied to the sheet 100.

Here, the processing liquid 201 capable of being foamed is a modification material that modifies the front surface of the sheet 100 when being applied to the front surface of the sheet 100. For example, the processing liquid 201 is a fixing agent (setting agent) capable of making the moisture of ink quickly permeate into the sheet 100, thickening a color component, accelerating the drying of the ink to prevent feathering, bleeding, and strike-through and improve productivity (the number of output images per unit time) provided that the processing liquid 201 is evenly applied to the sheet 100 (that is not limited to a paper as a material) in advance.

In terms of composition, the processing liquid 201 can be a solution in which celluloses (such as a hydroxylpropyl cellulose) for promoting the permeation of moisture and a base such as talc fine powder are added to, for example, a surfactant (any of an anion system, a cation system, and a nonion system, or a mixture of two or more of these systems). The processing solution can further contain fine particles.

The foam 210 is generated in the foam generation unit 205 when high-pressure air 222 is fed from a high-pressure air feeding unit 221 through a high-pressure air feeding path 223 to the processing liquid 201, and then is collected in a foam generation container 220. Due to pressure caused when the foam 210 is generated and collected in the foam generation container 220, the foam 210 is supplied to the foam supplying unit 207 through the foam supplying path 206. Note that the pump 203 is configured to close the supplying path 204 during the generation of the foam so that the foam 210 and the processing liquid 201 do not counterflow through the supplying path 204 through which the processing liquid 201 is supplied.

Figure 2:
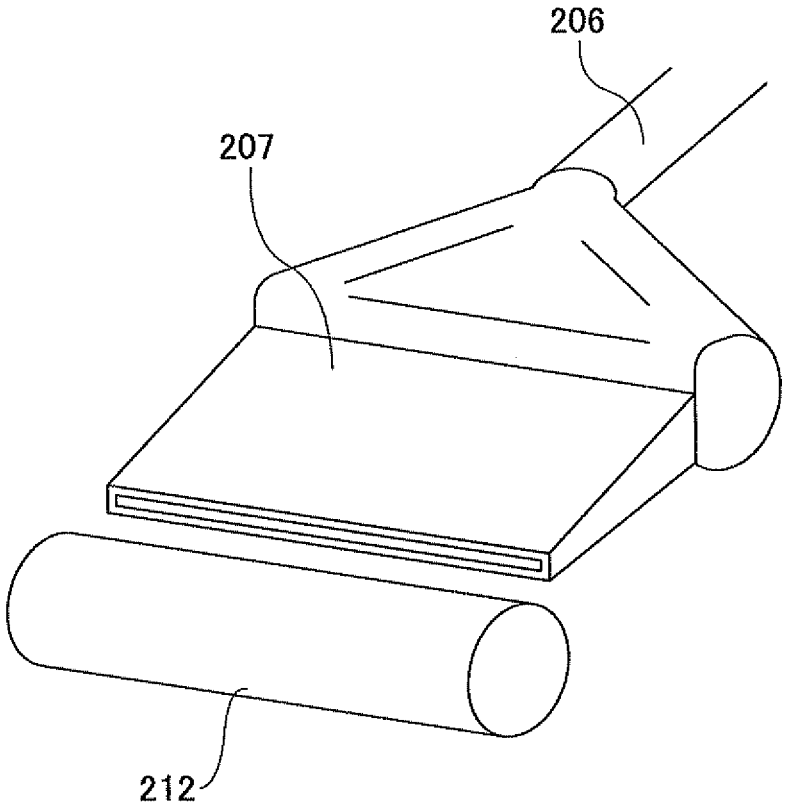
FIG. 2 is a perspective view showing an example of the foam supplying unit of the foam application device.

The foam application unit 207 supplies the foam 210 supplied through the foam supplying path 206 to the foam application roller 212 that applies the foam to the sheet 100 while spreading the foam 210 in a sheet width direction. In addition, the foam application unit 207 has an opening/closing unit 213 controlled to be opened and closed so as to correspond to a predetermined application region. As a method for spreading the foam 210 in the sheet width direction with the foam supplying unit 207, a known die head, for example, shown in FIG. 2 can also be used.

The foam 210 to be applied to the application roller 212 preferably has an air-foam content as a bulk density in the range of about 0.01 g/cm$^3$ through 0.1 g/cm$^3$.

Here, the "foam" is in a semi-solid state rather than in a liquid state and shows properties similar to solid matters in terms of fluidity, etc. That is, the foam 210 is generated from the processing liquid 201, but the generated "foam" per se is neither a "liquid" nor a "gel."

As described above, when the foam 210 is applied to the front surface of the sheet 100, the foam 210 is caused to include air in large amounts. Therefore, the processing agent of the foam 210 can be applied in minute amounts. As a result, a high quality image can be output without causing feathering, strike-through, density irregularities, etc., while attaining the uniform application of the foam 210 and improving its quick drying.

In other words, when the foamed processing agent is applied, the following advantages (effects) can be obtained compared with a case in which a liquid or mist-like processing liquid is applied.

(1) Since the foam includes air in large amounts, the processing agent can be applied in minute amounts.

(2) Since the foam is almost in a solid state, the thickness of an applied film can be easily controlled through a cutting operation even after the foam is applied. Also, since the foam is easily separated from the application unit when it is applied from the application unit to the sheet, it can be evenly applied.

(3) Since the moisture of the foam is not likely to penetrate into the fibers of the sheet, the sheet is not easily wrinkled and curled.

Such an application of the foam is excellent in that the same effects can be obtained regardless of the type of the processing agent. Note that the processing agent preferably has the effect of reducing the occurrence of sheet powder. In addition, the processing agent may have the effect of changing the texture color of the sheet.

Moreover, the use of the "foamed" matter as the processing agent for the medium to be recorded as described above provides a particular effect on high-speed recording and processing compared with a liquid processing agent. For example, in the case of a continuous printing machine that performs printing at high speed on a continuous sheet, it is necessary to rotate a roller, etc., at high speed to apply the processing agent because the application of the processing agent catches up with a recording operation.

When such a recording operation is performed at a speed more than about 100 meters per minute, an eccentric force generated due to the high-speed rotation of the roller becomes very large, the liquid processing agent is separated and scattered from the front surface of the roller, and the amount of the processing agent applied to the medium to be recorded is significantly reduced. In order to solve such problems using the liquid processing agent, it is assumed to increase the viscosity of the liquid so that the processing agent is hardly scattered from the front surface of the roller. In this case, however, it is difficult to apply such a high-viscosity liquid as a thin film. In addition, liquid feeding and discharging operations causes heavy loads, which results in the upsizing of a conveyance pump and the complexity of an apparatus.

Conversely, since the "foam" generated from the processing liquid typically constitutes a low-viscosity liquid when being supplied, causes only a small supplying load, and shows semi-solid properties in a foamed state on the roller, it can follow the high-speed rotation of the roller and are not scattered. As described above, the foam is advantageous in that it is applied to the medium to be recorded as a thin film. Moreover, the foam left on the roller after being applied to the medium can be easily collected as a low-viscosity liquid when it is heated with a heater. Thus, all the conventional problems in the application of the liquid processing agent at high speed can be solved.

Meanwhile, regarding the foam application device 200, in a case in which the foam is generated when gas (air in the embodiment) is fed and is supplied in accordance with the deposition of the foam, it is found that the foam naturally continues to be supplied due to residual air pressure in the foam supplying path and the pressure of the foam per se even if the supply of the air is stopped. Therefore, if the supply of the foam to the foam supplying path is continued even after the generation of the foam is stopped, the foam is unintentionally supplied and applied. For example, the foam is supplied to the region of the application roller corresponding to an area between the sheets and applied to the conveyance belt, etc.

In order to deal with this problem, the embodiments of the present invention provide a unit that increases the volume of the foam supplying path. With the provision of this unit, the volume of the foam supplying path is increased when the supply of the foam is stopped, thereby preventing the continuation of the natural supply of the foam due to the residual air pressure and the pressure of the foam per se.

Figure 3:
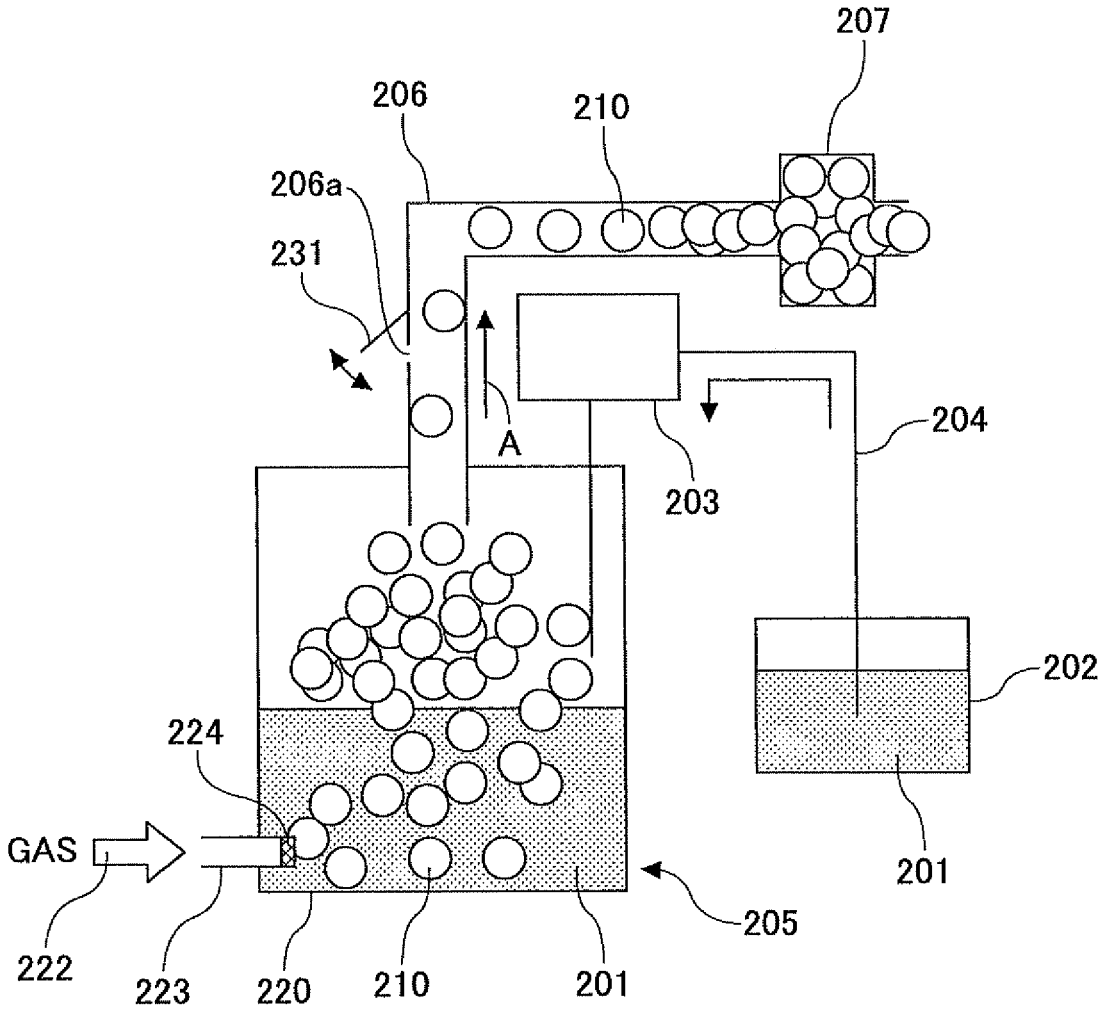
FIG. 3 is a schematic diagram showing a substantial part of the foam application device.

First, referring to a schematic diagram shown in FIG. 3, the foam application device according to a first embodiment of the present invention is described.

In the foam application device, the foam supplying unit 207 that supplies the foam 210 to the application roller 212 is arranged at a place relatively higher than the foam generation unit 205, and the foam generation unit 205 and the foam supplying unit 207 are connected to each other through the foam supplying path 206. Note that the processing liquid 201 is supplied from the container 202 with the pump 203 in the direction as indicated by an arrow.

At the tip end of the high-pressure air feeding path 223 facing the foam generation container 220 of the foam generation unit 205, a shear member 224 made of a fine mesh-like or porous-like member is provided. When the high-pressure air 222 passes through the shear member 224, it is sheared into fine diameter matter and ejected into the processing liquid 210. As a result, the fine foam 210 is generated from the processing liquid in a short period of time. Moreover, when the foam generation container 220 of the foam generation unit 205 is at a high pressure, the pressure is opened to atmospheric pressure, which in turn causes the foam 210 to be supplied through the foam supplying path 206 to the foam supplying unit 207 having a pressure lower than that of the foam generation container 220.

The foam supplying path 206 is provided with an opening/closing valve 231 as a unit that increases the volume of the foam supplying path 206 by making a part 206*a* opened to the atmosphere. The opening/closing valve 231 is opened so that the supply of the foam to the foam supplying unit 207 is stopped. Thus, the volume of the foam supplying path 206 is substantially increased.

In other words, the opening/closing valve 231 is closed during image formation. The foam 210 generated by the foam generation unit 205 is supplied to the foam supplying unit 207 through the foam supplying path 206 and then supplied to the application roller 212 from the foam supplying unit 207. After that, the foam 210 is applied to the sheet 100 as described above.

When the supply of the high-pressure air 222 to the foam generation container 220 of the foam generation unit 205 is stopped upon the completion of the image formation, the foam is no longer generated. However, the pressure on the downstream side (on the side of the foam supplying unit 207) in the foam supplying path 206 becomes lower than that on the upstream side (on the side of the foam generation unit 205) due to the residual air pressure and the pressure of the foam per se in the foam supplying path 206.

Therefore, even if the supply of the high-pressure air 222 is stopped, the foam 210 of the foam generation unit 205 is continuously supplied for a while from the upstream side to the downstream side in the foam supplying path 206, which in turn causes unnecessary foam 210 to overflow from the foam supplying unit 207 to be supplied to the peripheral surface of the application roller 212.

In view of the above circumstance, the foam application device according to the embodiment of the present invention controls the opening/closing valve 231 so as to be opened with a driving control unit not shown when stopping the supply of the foam to the application roller 212. Accordingly, the part 206*a* of the foam supplying path 206 is opened, whereby the volume of the foam supplying path 206 is substantially increased and the pressure in the foam supplying path 206 near the foam generation unit 205 is reduced to atmospheric pressure. Then, the foam 210 is partially supplied in the direction opposite to the direction to the foam supplying unit 207 (in the direction opposite to the direction as indicated by an arrow A) in the meantime. As a result, the foam 210 is not naturally supplied to the foam supplying unit 207, thereby preventing the unnecessary foam 210 from overflowing from the foam supplying unit 207 to be supplied to the peripheral surface of the application roller 212 and applied to an undesired part.

As described above, the foam application device has the foam generation unit that generates the foam, the application unit that applies the generated foam to the medium to be recorded (or an intermediate member or a member to be applied), the foam supplying path through which the generated foam is supplied to the application unit, and the unit that increases the volume of the foam supplying path; it is configured to increase the volume of the foam supplying path when stopping the supply of the foam to the application unit. As a result, the foam application device can apply the foam with an even thickness and prevent the foam from overflowing from the foam supplying unit to be applied to the undesired part after stopping the supply of the foam.

Figure 4:
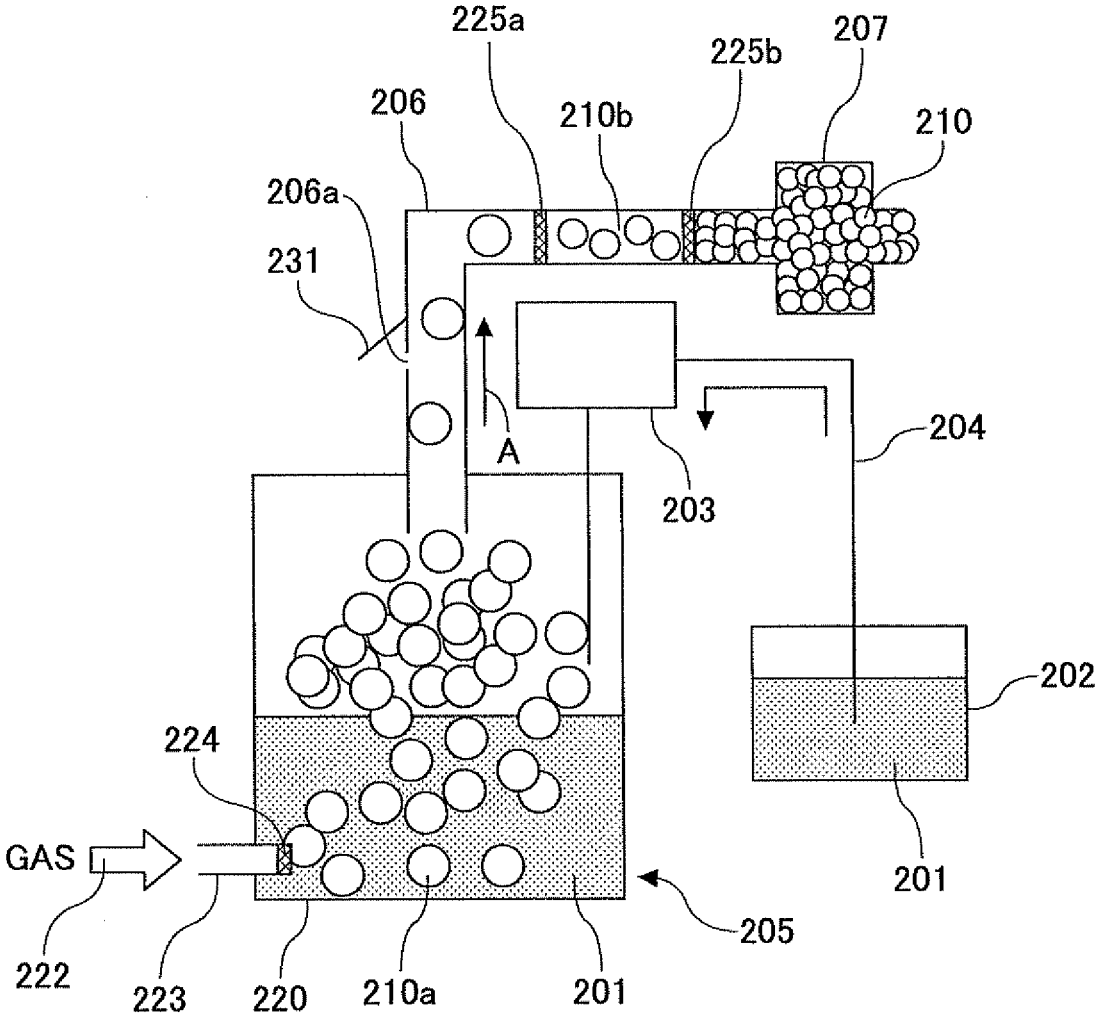
FIG. 4 is a schematic diagram showing a substantial part of the foam application device according to a second embodiment of the present invention.

Next, referring to a schematic diagram shown in FIG. 4, the foam application device according to a second embodiment of the present invention is described.

In this embodiment, one or more foam shear members 225 (i.e., two foam shear members 225*a* and 225*b*) that micronize the foam are provided in the foam supplying path 206. When desired fine foam 210 suitable for image formation cannot be obtained only with the shear member 224 provided at the tip end of the high-pressure air feeding unit in the foam generation unit 205, the foam 210 (called "large foam") generated by the foam generation unit 205 is sheared with the foam shear member 225*a* of the foam supplying path 206 to be micronized into medium foam 210*b*, and then it is further sheared with the foam shear member 225*b* to be micronized into small foam 210.

With this configuration, the foam application device can efficiently generate the foam 210 suitable for application and supply it to the foam supplying unit 207.

Note that in this case, the "large foam" and the "small foam" that distinguish the sizes of the foam are defined as follows.

Large foam: "Foam in a first state" is specified. The large foam is generated from a liquid (or a gel or both the liquid and the gel) to be foamed, but it cannot exert the effect obtained when the "foam" is applied as described above.

Small Foam: "Foam in a second state" is specified. The small foam is generated from the large foam (the foam in the first state), and its foam diameter is smaller than that of the large foam (the foam in the first state). In this state, the small foam can exert the effect obtained when the "foam" is applied as described above.

Medium foam: Foam whose size is between the large foam and the small foam.

Here, the position at which the opening/closing valve 231 is provided is described.

As described in the first embodiment, when the supply of the high-pressure air 222 is stopped and the pressure in the foam supplying path 206 is reduced with the opening/closing valve 231 of the foam supplying path 206, the foam 210 is partially supplied in the direction opposite to the direction to the foam supplying unit 207 (in the direction opposite to the direction as indicated by the arrow A). Assuming that a pressure between the foam generation unit 205 and the first foam shear member 225 is P1, a pressure between the first foam shear member 225*a* and the second foam shear member 225*b* is P2, and a pressure after the second foam shear member 225*b* is P3, the relationship P1>P2>P3 is established as the pressure in the foam supplying path 206 before the opening/closing valve 231 is opened (before the volume of the foam supplying path is increased).

At this time, when the opening/closing valve 231 is provided at the position corresponding to the pressure P1 and actuated (opened) thereat, the relationship P1<P2>P3 is temporarily established. Therefore, the foam counterflows from the position corresponding to the pressure P2 to that corresponding to the pressure P1. When the balance between the pressures is achieved (P1=P2=P3), the counterflow of the foam is stopped. Since the opening/closing valve 231 is provided near the foam generation unit 205, the pressure at the position P1 having the maximum pressure is first reduced. Thus, the pressures in the foam supplying path can be efficiently reduced. Furthermore, since the foam 210 is partially returned to the foam generation container 220 of the foam generation unit 205, the useless outflow of the foam 210 to the outside (on the side of the atmosphere) of the foam supplying path 206 having a low pressure can be minimized.

Figure 5:
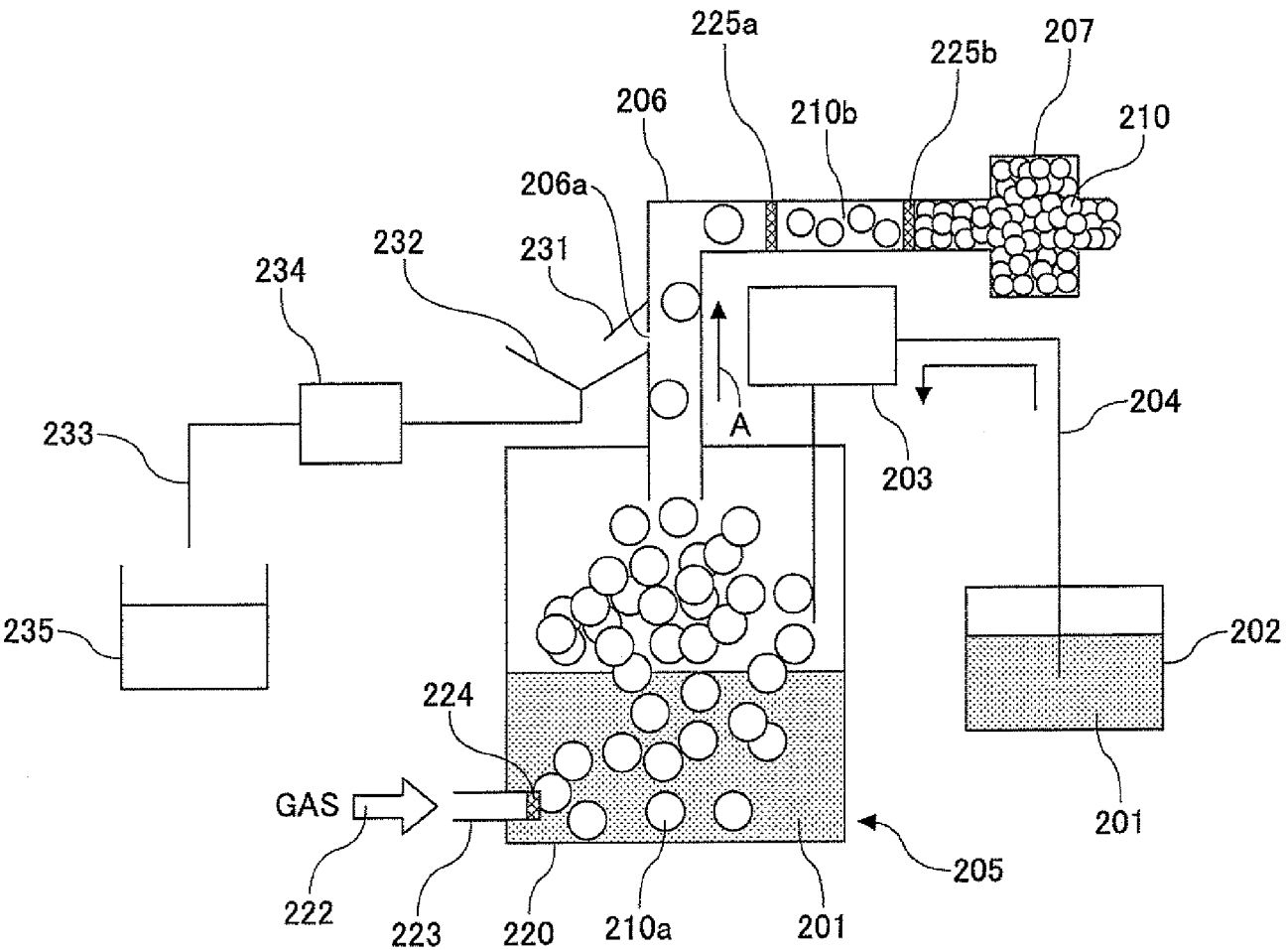
FIG. 5 is a schematic diagram showing a substantial part of the foam application device according to a third embodiment of the present invention.

Then, referring to a schematic diagram shown in FIG. 5, the foam application device according to a third embodiment of the present invention is described.

In this embodiment, the foam application device is provided with an outflowing agent receiving unit 232 that collects the foam 210 outflowing from the foam supplying path 206 when the opening/closing valve 231 of the foam supplying path 206 is opened and closed, an outflowing agent supplying path 233 through which the foam (or the processing liquid 201 converted from the foam: an outflowing agent) collected into the outflowing agent receiving unit 232 is supplied, an outflowing agent supplying unit 234 such as a pump, and an outflowing agent storage unit 235 that stores the outflowing agent.

In other words, as described above, when the opening/closing valve 231 is opened, the foam 210 in the foam supplying path 206 is returned in the direction to the foam generation container 220 of the foam generation unit 205. At this time, some foam outflows through the opening/closing valve 231. Therefore, with the above configuration, the outflowing agent such as the foam outflowing from the foam supplying path can be collected and stored, thereby preventing the useless consumption of the processing liquid 201.

Figure 6:
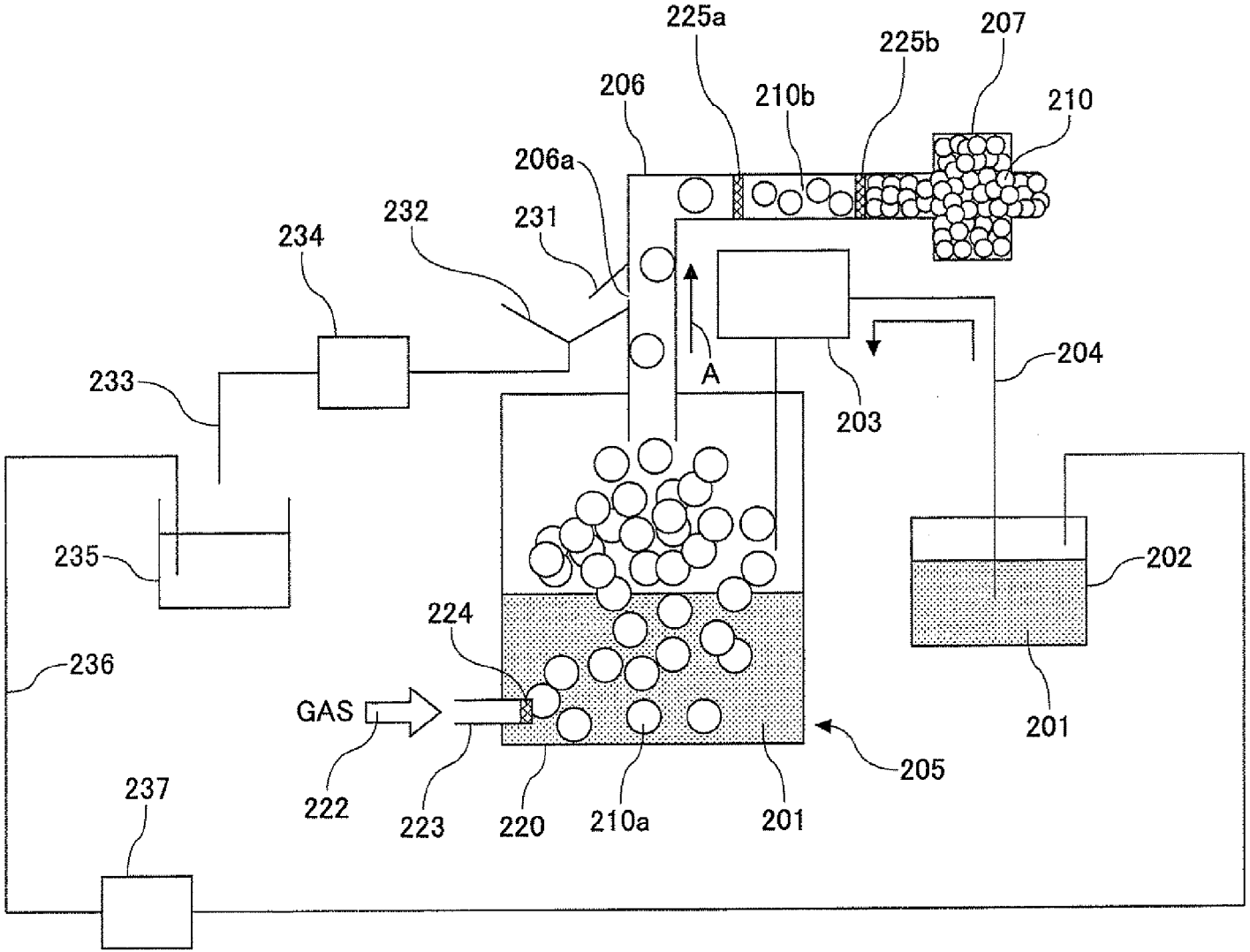
FIG. 6 is a schematic diagram showing a substantial part of the foam application device according to a fourth embodiment of the present invention.

Next, referring to a schematic diagram shown in FIG. 6, the foam application device according to a fourth embodiment of the present invention is described.

In this embodiment, the foam application device is provided with a returning path 236 through which the outflowing agent from the outflowing agent storage unit 235 described in the third embodiment is returned to the container 201 that stores the processing liquid 201 and a return supplying unit 237 such as a pump that supplies the outflowing agent in the returning path 236. With this configuration, the foam application device can generate the foam while reusing the outflowing agent.

Then, referring to the schematic diagram shown in FIG. 6, the foam application device according to a fifth embodiment of the present invention is described.

In this embodiment, the foam application device according to the fourth embodiment normally generates the foam 210 with the foam generation unit 205 while opening the opening/closing valve 231. On the other hand, it closes the opening/closing valve 231 when supplying the foam 210 from the foam supplying unit 207 to the application roller 212.

In other words, the foam 210 generated by the foam generation unit 205 is returned to the container 202 for the processing liquid 202 through the outflowing agent supplying path 233 and the returning path 236 when the opening/closing valve 231 is opened. On the other hand, the foam 210 is supplied to the foam supplying unit 207 through the foam supplying path 206 when the opening/closing valve 231 is closed. Therefore, when the opening/closing valve 231 is opened again to reduce the pressure on the side of the foam generation unit 205 in the foam supplying path 206 as described above, the natural supply of the foam 210 from the foam supplying unit 207 can be stopped.

That is, in this embodiment, the foam application device is provided with the returning path 236 that is branched from the foam supplying path 206 and returns the foam 210 from the foam generation unit 205 to the container 202 as a unit that supplies the processing liquid 201 and the opening/closing valve 231 as an opening/closing unit that opens/closes the returning path 236. The foam application device is controlled to close the opening/closing valve 231 when supplying the foam 210 to the foam supplying unit 207 and open the opening/closing valve 231 when stopping the supply of the foam 210 to the foam application unit 207.

Figure 7:
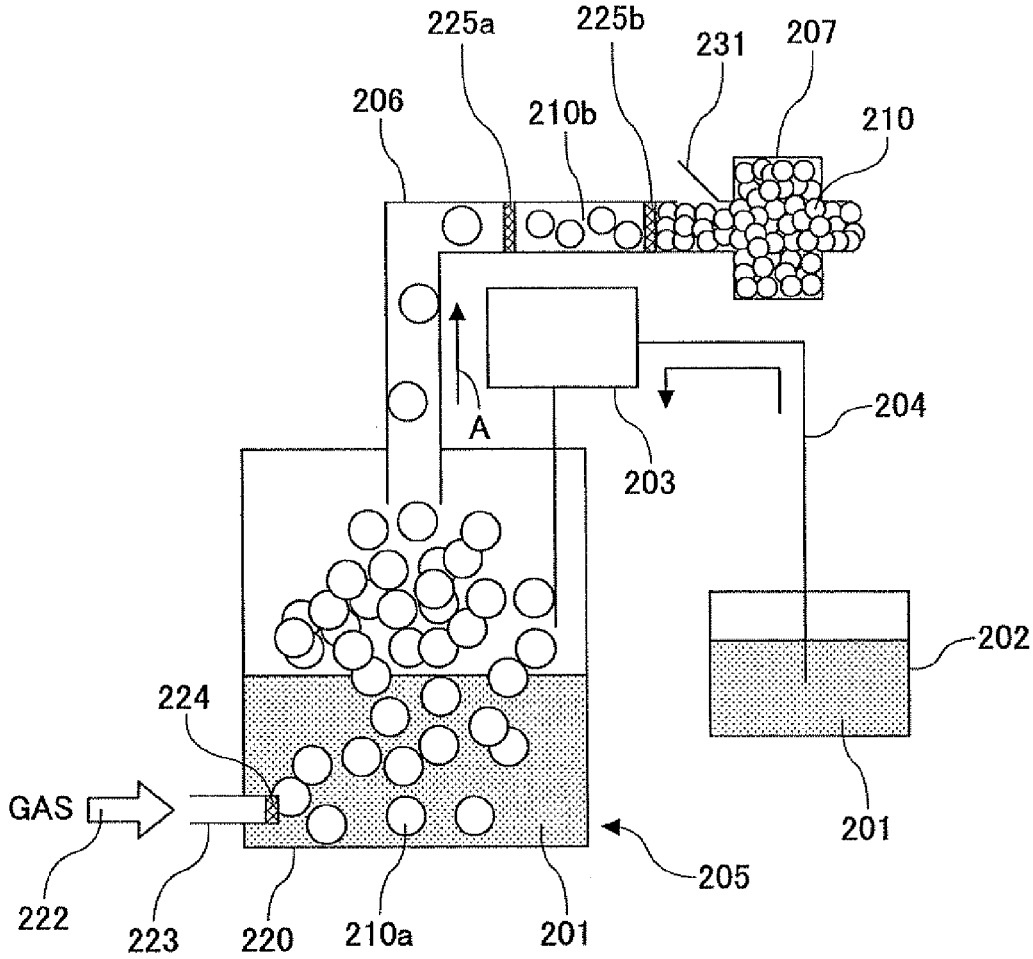
FIG. 7 is a schematic diagram showing a substantial part of the foam application device according to a sixth embodiment of the present invention.

Next, referring to a schematic diagram shown in FIG. 7, the foam application device according to a sixth embodiment of the present invention is described.

In this embodiment, the opening/closing valve 231 is provided near the foam supplying unit 207. In this case, the natural supply of the foam 210 can be prevented when the opening/closing valve 231 is opened to reduce the pressure in the foam supplying path 206.

Figure 8:
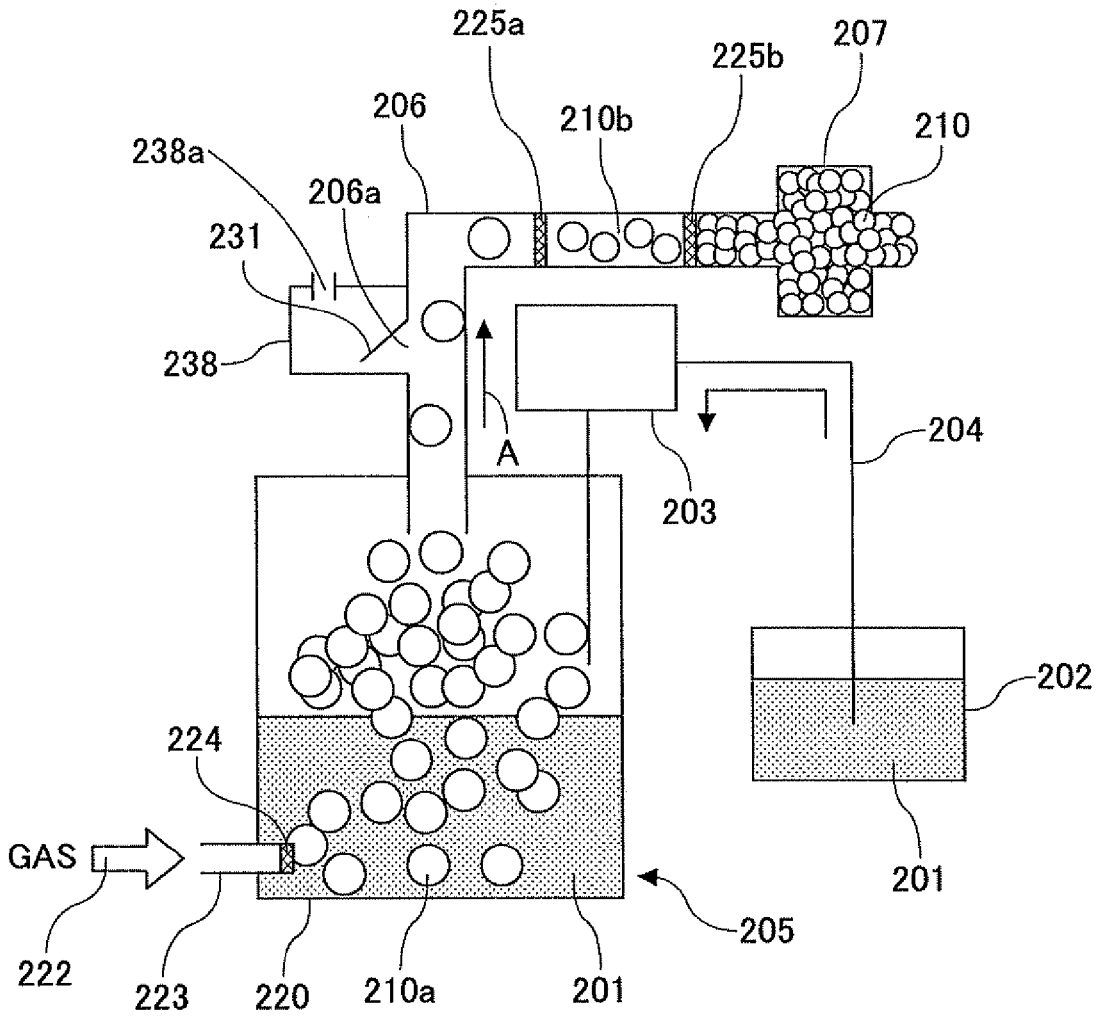
FIG. 8 is a schematic diagram showing a substantial part of the foam application device according to a seventh embodiment of the present invention.

Then, referring to a schematic diagram shown in FIG. 8, the foam application device according to a seventh embodiment of the present invention is described.

In this embodiment, an outflowing agent receiving unit 238 that forms a space surrounding the periphery of the opening/closing valve 231 is provided. Note that the outflowing agent receiving unit 238 is provided with an air releasing hole 238*a*. In this case, the volume of the foam supplying path 206 increases when the opening/closing valve 231 is opened. Therefore, even if the foam 210*b*, etc., outflow through the opening/closing valve 231, it is received by the outflowing agent receiving unit 238 and directly returned to the foam generation container 220. As a result, the outflow of the foam 210*b*, etc., to the outside of the device can be prevented.

Figure 9:
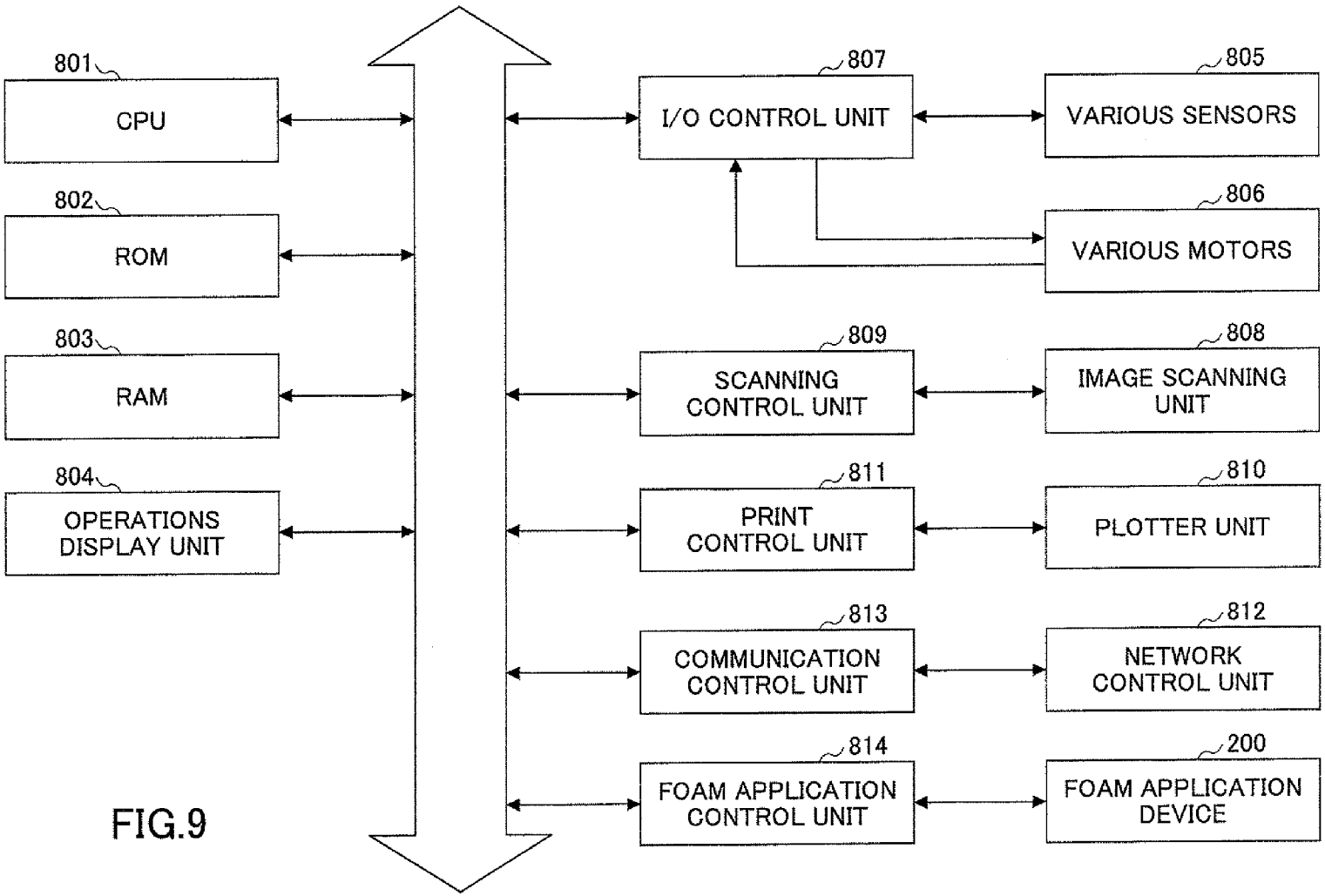
FIG. 9 is a block diagram showing the brief summary of the control unit of the image forming apparatus.

Here, referring to a block diagram shown in FIG. 9, a description is made of the brief summary of the control unit of an image forming apparatus having the foam application device according to the first embodiment of the present invention.

The control unit has a CPU 801 that controls the system of the image forming apparatus; a ROM 802 that stores information on a program executed by the CPU 801; a RAM 803 that serves as a work area; an operations display unit 804 through which an operator performs various settings, etc.; various sensors 805 that detect the size of a sheet and jamming; various motors 806; an I/O control unit 807 that controls an input/output to and from the various sensors 805 and the various motors 806; a scanning control unit 809 that controls an image scanning unit (scanner) 808; a print control unit 811 that controls a plotter unit (print mechanism unit) 810; a communication control unit 813 that controls various facsimile communications including a network control unit 812 that performs I/F control with telephone lines; a foam application control unit 814 that controls the foam application device 200; and the like.

Among the above units, the various sensors 805 have a liquid end detection unit that detects the presence or absence of the processing liquid 201 in the container 202 and driving units such as a motor that rotates the pump 203, the application roller 212, a supply amount/supplying region control unit 216, the conveyance roller 121, the sheet feeding rollers 132, the pick-up roller 131, etc., and a solenoid that opens and closes the opening/closing valve 231.

Figure 10:
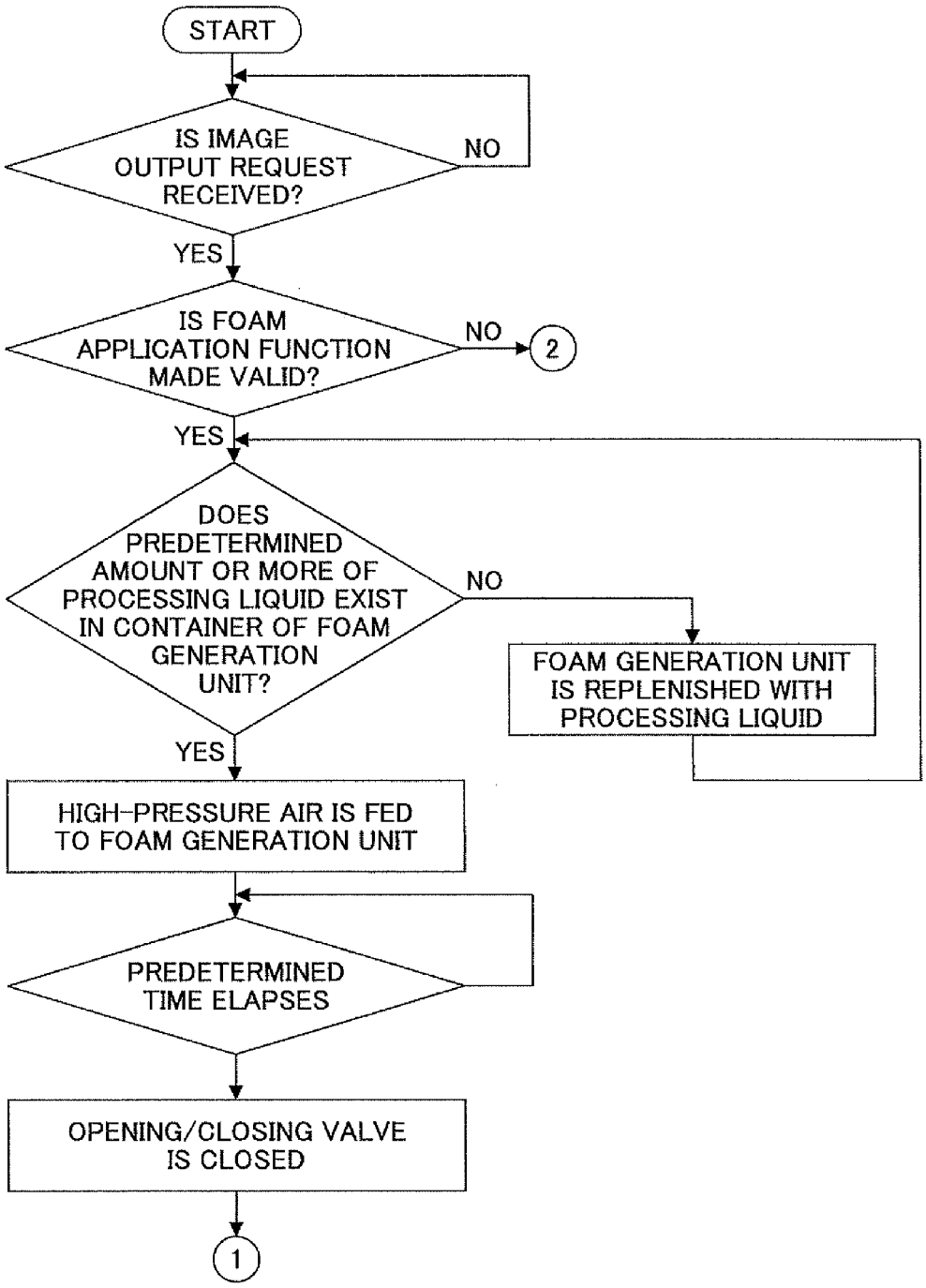
FIG. 10 is a flowchart for explaining an example of a printing process with the control unit.
Figure 11:
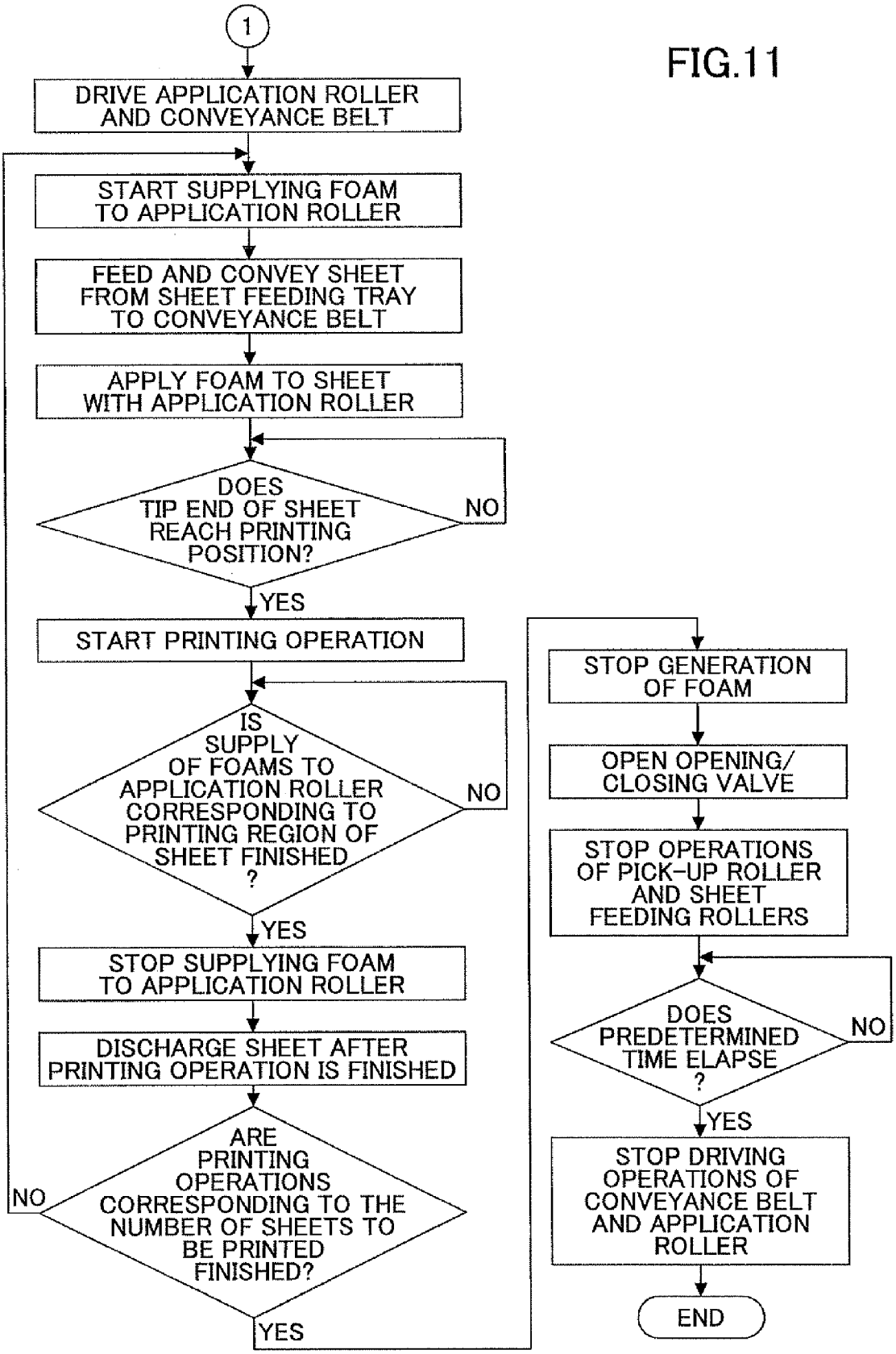
FIG. 11 is a flowchart for explaining the process following processing steps in FIG. 10.
Figure 12:
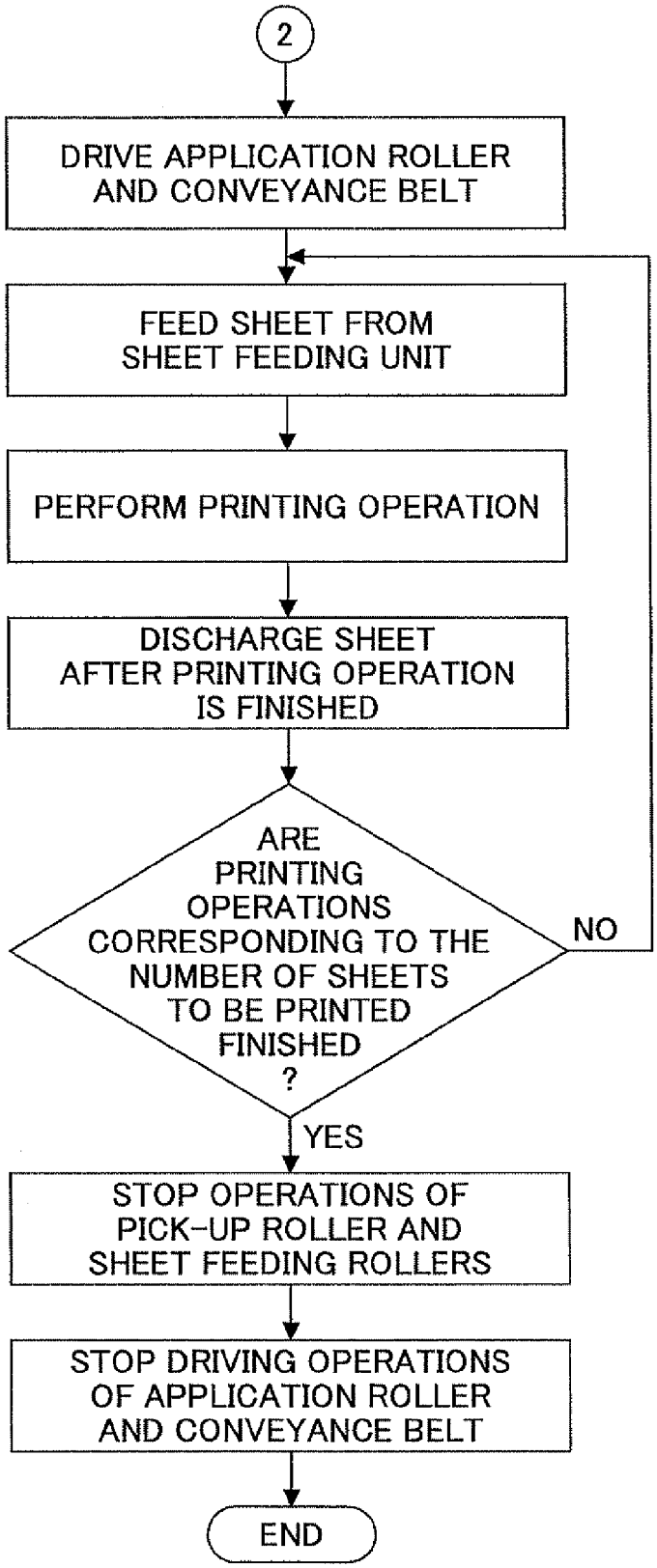
FIG. 12 is a flowchart for explaining the process following the processing steps in FIG. 10.

Next, referring to flowcharts shown in FIGS. 10 through 12, a description is made of an example of a printing process in the image forming apparatus.

As shown in FIG. 10, upon receipt of an image output request sent from an external information processing apparatus or the operations display unit 804, the image forming apparatus determines whether a foam (setting agent) application function is made valid. When the foam application function is made valid, the image forming apparatus then determines whether a predetermined amount or more of the processing liquid 201 exists in the container 220 of the foam generation unit 205. At this time, when the predetermined amount or more of the processing liquid 201 does not exist in the container 220 of the foam generation unit 205, the image forming apparatus drives the pump 203 to replenish the container 220 of the foam generation unit 205 with the processing liquid 201 of the container 202. On the other hand, when the predetermined amount or more of the processing liquid 201 exists in the container 220 of the foam generation unit 205, the image forming apparatus immediately feeds the high-pressure air 222 to the foam generation unit 205 to generate the foam 210. After that, the image forming apparatus closes the opening/closing valve 231 when a predetermined time elapses after starting the feeding of the high-pressure air 222.

Then, as shown in FIG. 11, the image forming apparatus starts driving the application roller 212 and the conveyance belt 102, opens the opening/closing unit 213 of the foam supplying unit 207 at a predetermined timing, and starts supplying the foam 210 to the front surface of the application roller 212. Thus, the foam 210 is carried on the front surface of the application roller 212, controlled to have a predetermined thickness with the thickness control unit 214, and transferred to the conveyance belt 102.

Subsequently, the image forming apparatus conveys the medium 100 to be recorded (sheet) from the sheet feeding unit (the sheet feeding cassette 103) to the conveyance belt 102 and applies the foam 210 to the medium 100 with the application roller 212. Then, the image forming apparatus starts a printing operation when the tip end of the medium 100 reaches the printing position of the head unit 101. On the other hand, when the supply of the foam 210 to the application roller 212 corresponding to the printing region of the sheet 100 is finished, the image forming apparatus closes the opening/closing unit 213 of the foam supplying unit 207 to stop supplying the foam 210 to the application roller 212.

Then, after discharging the medium 100 on which the printing operation has been performed, the image forming apparatus repeatedly performs the processing steps from the sheet feeding operation until the printing operations corresponding to the number of sheets to be printed are finished. When the printing operations corresponding to the number of sheets to be printed are finished, the image forming apparatus stops feeding the high-pressure air 222 to the foam generation unit 205 to stop the generation of the foam and opens the opening/closing valve 222 of the foam supplying path 206 to reduce the pressure on the side of the foam generation unit 205 in the foam supplying path 206. After that, the image forming apparatus stops the operations of the pick-up roller 131 and the sheet feeding rollers 132 and stops the driving operations of the conveyance belt 102 and the application roller 212 after a predetermined time elapses, i.e., after the elapse of the predetermined time in which a cleaning operation for the application roller 212 is completely finished.

On the other hand, in FIG. 10, if there is no need to supply the foam 210, such as a case where a special medium to be recorded is used, the foam application function is made invalid. Therefore, when the foam application function is not made valid, the process proceeds to processing steps shown in FIG. 12 where the image forming apparatus drives the application roller 212 and the conveyance belt 102, feeds the medium 100 from the sheet feeding unit, performs the printing operation on the medium 100 with the head unit 101, and discharges the medium 101. When the printing operations corresponding to the number of sheets to be printed are finished, the image forming apparatus stops the operations of the pick-up roller 131 and the sheet feeding rollers 132 and stops the driving operations of the conveyance belt 102 and the application roller 212 after the predetermined time elapses.

At this time, the application roller 212 is rotated for the following reason. That is, a gap between the application roller 212 and the conveyance belt 102 is smaller than or equal to the sum of the thickness of the medium and the film thickness of the foamed setting agent 201 at maximum, or it is smaller than or equal to the thickness of the medium at maximum in a configuration in which the application roller is pressed to apply the foam. Therefore, the application roller 212 is driven so that the conveyance of the medium 100 is not prevented.

Note that in the above embodiments, the foam application device is configured to apply the foam to the sheet before image formation. Alternatively, the foam application device may be arranged on the downstream side of the recording head unit and apply the foam on the medium on which image formation is performed. Furthermore, in the above embodiments, the foam is generated from the liquid capable of being foamed and applied. Alternatively, the embodiments of the present invention can also be applied to a device that generates the foam from the gel capable of being foamed and applies the generated foam to a member to be applied. In addition, it can also be applied to an image forming apparatus having this device.

Furthermore, the foam application device according to the embodiments of the present invention can also be applied to, for example, an electrophotographic image forming apparatus. For example, it can also be applied to a fixing method, a fixing device, an image forming method, and an image forming apparatus in which a fixing liquid is foamed (hereinafter referred to as "fixing foam") and applied to a medium, to which resin-containing fine particles are attached, without disturbing the resin-containing fine particles such as toner on the medium, thereby quickly fixing the resin-containing fine particles to the medium after the application of the fixing foam and preventing a residual oily feeling upon touching the medium.

Figure 13A:
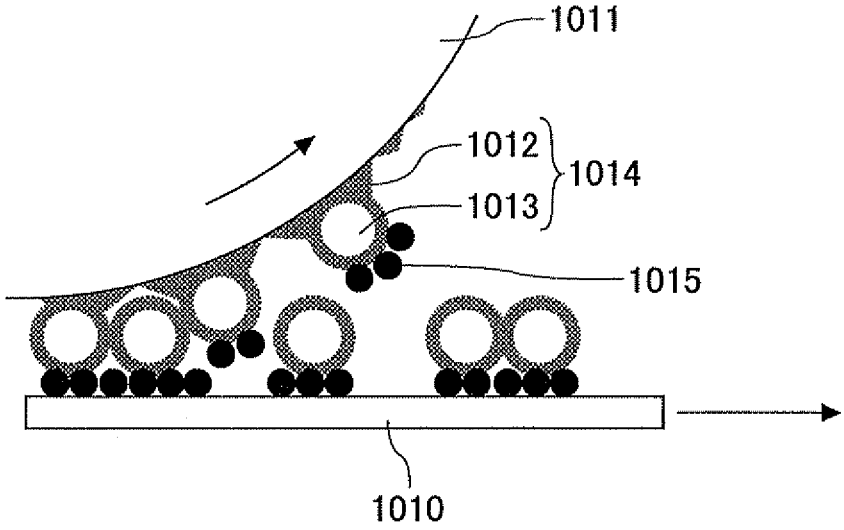
FIGS. 13A and 13B are enlarged views showing a part at which the application surface of an application roller is brought into contact with unfixed resin-containing fine particles in a state in which a pressure between the application roller and the contact surface of a recording medium is relatively high when the foam application device according to the embodiments of the present invention is applied to an electrophotographic image forming apparatus.
Figure 13B:
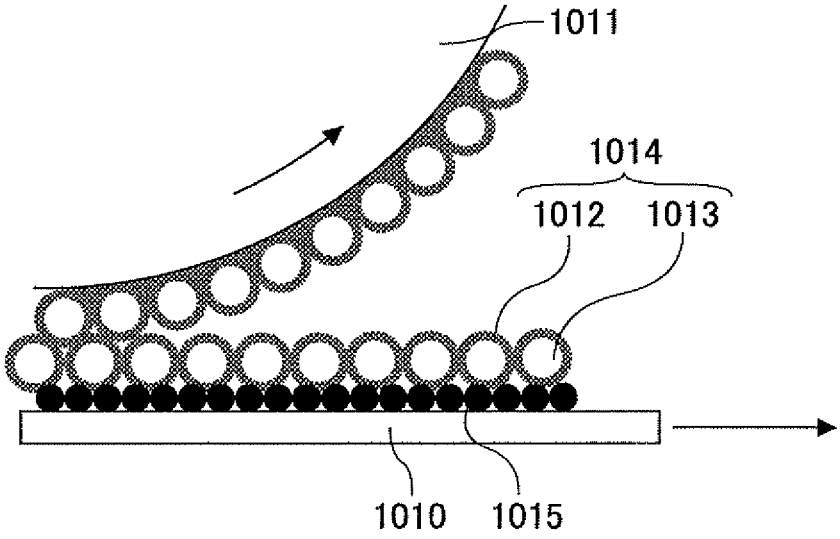
Figure 14A:
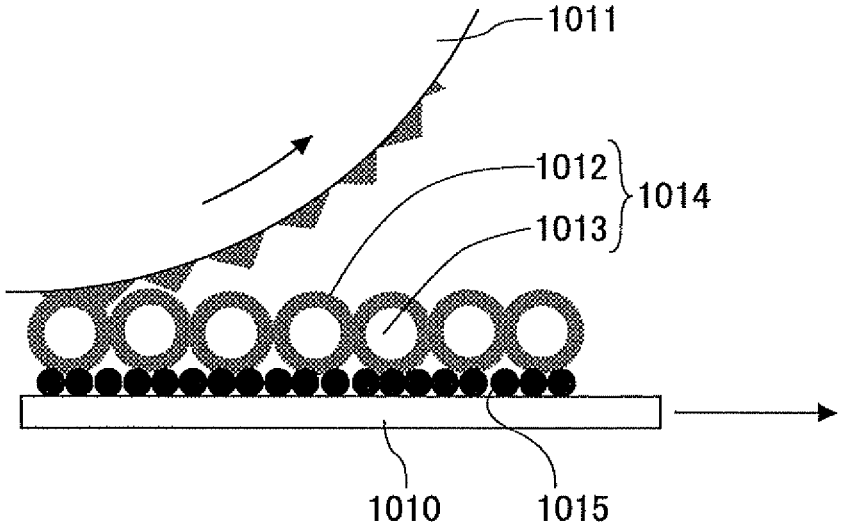
FIGS. 14A and 14B are enlarged views showing a part at which the application surface of the application roller is brought into contact with the unfixed resin-containing fine particles in a state in which a pressure between the application roller and the contact surface of the recording medium is relatively low.
Figure 14B:
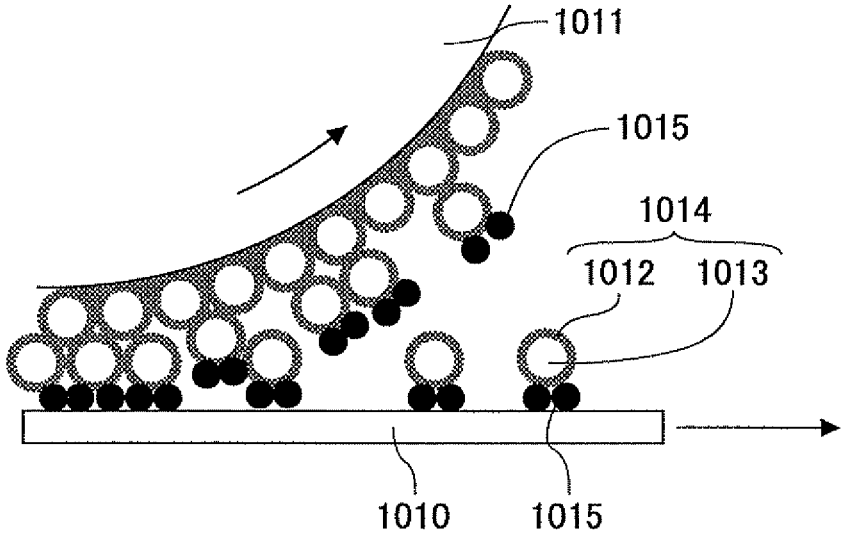

Now, referring to FIGS. 13A, 13B, 14A, and 14B, a description is made of an example of a case in which the embodiments of the present invention are applied to the electrophotographic image forming apparatus. FIGS. 13A, 13B, 14A, and 14B are enlarged views of a part at which the roller application surface of a roller application unit is brought into contact with unfixed resin-containing fine particles. FIGS. 13A and 13B show a case in which an application roller is brought into contact with the contact surface of a recording medium with a relatively high pressure. On the other hand, FIGS. 14A and 14B show a case in which the application roller is brought into contact with the contact surface of a recording medium with a relatively low pressure. Furthermore, the rotational direction of an application roller 1011 and the moving direction of a recording medium 1010 as a member to be applied are indicated by arrows in the figures.

First, in the example shown in FIG. 13A, when the application roller 1011 is brought into contact with the recording medium 1010 with a high pressure, fixing foam 1012 is structured to have a single layer of air foam 1013 at the application surface of the application roller 1011. Therefore, the air foam 1013 per se is likely to adhere to the application surface of the application roller 1011 due to its surface tension, and the fixing foam 1012 is only unevenly applied to the layer of resin-containing fine particles (unfixed toner) 1015 on the recording medium 1010. As a result, the resin-containing fine particles 1015 are adsorbed to the air foam 1013 and offset to the application surface of the application roller 1011.

On the other hand, as shown in FIG. 13B, when the fixing foam 1012 is structured to have plural layers of the air foam 1013 at the application surface of the application roller 1011, the surface irregularities of the unfixed toner 1015 can be filled with the air foam 1013, and the fixing foam 1012 can be easily separated at a place between the layers of the air foam 1013. In addition, the fixing foam 1012 can be evenly supplied to the layer of the unfixed toner 1015. As a result, the offset of the toner can be hardly caused.

Therefore, when the application roller 1011 is brought into contact with the contact surface of the recording medium 100 with a high pressure, an average size of the air foam 1013 to be generated is measured in advance and the film thickness of the layer of the fixing foam 1012 on the application roller 1011 is controlled to be equal to the thickness of the plural layers of the air foam 1013. Thus, the fixing foam 1012 having the plural layers of the air foam 1013 is necessarily formed on the application roller 1011, thereby making it possible to prevent the unfixed toner 1015 from being offset to the application roller 1011.

Furthermore, as shown in FIG. 14A, when the application roller 1011 is brought into contact with the contact surface of the recording medium 1010 with a low pressure, the fixing foam 1012 is structured to have a single layer of the air foam 1013 at the application surface of the application roller 1011. Therefore, the air foam 1013 is likely to adhere to the surface of the unfixed toner 1015 having irregularities, the layer of the air foam 1013 is separated from the surface of the application roller 1011, and the fixing foam 1012 is applied to the unfixed toner 1015.

On the other hand, as shown in FIG. 14B, when the fixing foam 1012 is structured to have plural layers of the air foam 1013 at the application surface of the application roller 1011, a lot of air foam 1013 are firmly bonded together. Therefore, the air foam 1013 is likely to remain on the application roller 1011, and the unfixed toner 1015 adheres to the air foam 1013. As a result, the unfixed toner 1015 is offset to the surface of the application roller 1011.

Accordingly, when the application roller 1011 is brought into contact with the contact surface of the recording medium 1010 with a low pressure, an average size of the air foam 1013 is measured in advance, and the thickness of the layer of the fixing foam 1012 is controlled so that the fixing foam 1012 are structured to have a single layer of the air foam 1013 at the application roller. Thus, the film of the fixing foam 1012 having the single layer of the air foam 1013 is formed on the application roller 1011, and the offset of the toner can be prevented in a state in which the application roller 1011 is brought into contact with the contact surface of the recording medium 100 with a low pressure. Furthermore, when the layer of the air foam 1013 on the application roller 1011 is too thick, the flow of the layer of the air form 1013 is caused at a contact place between the application roller 1011 and the recording medium 1010. Thus, the toner particles move together with the flow of the layer of the air foam 1013, which results in the flow of an image. Therefore, in order to prevent the unfixed toner 1015 from being offset to the application roller 1011, the film thickness of the layer of the fixing foam 1012 is preferably controlled to a degree so as not to cause the fluidity.

As described above, the film thickness of the layer of the fixing foam 1012 is controlled in accordance with the size of the air foam 1013 included in the fixing foam 1012 and a pressurizing force, thereby making it possible to prevent the offset of the toner to a contact application unit such as the application roller 1011 and the flow of an image and to realize the fixation of the fixing foam in an extremely slight amount.

In other words, the above description refers to a method in which the fixing liquid is applied to the resin-containing fine particles on the medium 100 so that the resin-containing fine particles are fixed to the medium 100, using a softening agent that dissolves or swells a part of the resin-containing fine particles to soften the resin-containing fine particles. When the fixing liquid is applied to the front surface of the resin-containing fine particles on the medium, it contains air foam and the film thickness of the fixing foam layer is controlled in accordance with a pressurizing force. Thus, it is possible to prevent the offset of the toner to the contact application unit such as the application roller 1011 and the flow of an image and to realize the fixation of the fixing foam 1012 in an extremely slight amount. Furthermore, the fixing liquid has an enhanced effect on the toner fine particles used for an electrophotographic technique, and the offset of toner and the flow of an image can be prevented when the film thickness of the layer of the fixing foam 1012 is controlled in accordance with the thickness of the layer of the resin-containing fine particles.

As described above, the image forming apparatus and the foam application device according to the embodiments of the present invention have the foam generation unit that generates foam; the application unit that applies the generated foam to the medium to be recorded, the intermediate member, or the member to be applied; the foam supplying path through which the generated foam is supplied to the application unit; and the unit that increases the volume of the foam supplying path. In addition, the image forming apparatus and the foam application device are configured to increase the volume of the foam supplying path when stopping the supply of the foam to the application unit. With this configuration, the foam can be applied with an even thickness. In addition, the outflowing of the foam having a pressure and the application thereof to unnecessary parts can be prevented after the application of the foam is stopped.

Furthermore, the image forming apparatus according to the embodiments of the present invention has the foam generation unit that generates foam; the application unit that applies the generated foam to the medium to be recorded or the intermediate member; the foam supplying path through which the generated foam is supplied to the application unit; the returning path that is branched from the foam supplying path and through which the foam is returned to the foam generation unit or the unit that supplies at least any one of the liquid and the gel to the foam generation unit; and the opening/closing unit that opens and closes the returning path. In addition, the image forming apparatus is configured to open the opening/closing unit when supplying the foam to the application unit and opens the opening/closing unit when stopping the supply of the foam to the application unit. With this configuration, the foam can be applied with an even thickness. In addition, the outflowing of the foam having a pressure and the application thereof to unnecessary parts can be prevented after the application of the foam is stopped.

The present application is based on Japanese Priority Application No. 2008-134907 filed on May 23, 2008 and Japanese Priority Application No. 2009-013727, filed on Jan. 24, 2009 with the Japan Patent Office, the entire contents of which are hereby incorporated by reference.

The invention claimed is:

1. An image forming apparatus comprising:

an image forming unit that forms an image on a medium to be recorded; and a foam application unit that applies a foam generated from at least any one of a liquid and a gel to the medium to be recorded or an intermediate member for applying the foam to the medium to be recorded, wherein the foam application unit has a foam generation unit that generates the foam, an application unit that applies the generated foam to the medium to be recorded or the intermediate member, a foam supplying path through which the generated foam is supplied to the application unit, and a unit that increases a volume of the foam supplying path, and wherein the foam application unit increases the volume of the foam supplying path at a specific moment in time when generation of the foam by the foam generation unit is being stopped, and wherein when the supply of the foam to the application unit is being stopped, the unit that increases the volume of the foam supplying path cause the foam to travel in a direction that the foam does not travel during foam supply operation.

2. The image forming apparatus according to claim 1, wherein the foam is collected through the unit that increases the volume of the foam supplying path.

3. The image forming apparatus according to claim 2, wherein the collected foam is returned to the foam generation unit or a unit that supplies any one of the liquid and the gel to the foam generation unit.

4. The image forming apparatus according to claim 1, wherein the unit that increases the volume of the foam supplying path is a unit that opens the foam supplying path to atmosphere.

5. The image forming apparatus according to claim 1, wherein the foam is generated when gas is supplied to the foam generation unit and supplied to the application unit through the foam supplying path.

6. The image forming apparatus according to claim 1, wherein the foam supplying path is provided with a unit that micronizing the foam.

7. A foam application device that applies a foam generated from at least any one of a liquid and a to a member to be applied, the foam application device comprising:

a foam generation unit that generates the foam;

an application unit that applies the generated foam to the member to be applied;

a foam supplying path through which the generated foam is supplied to the application unit; and a unit that increases a volume of the foam supplying path; wherein the foam application unit increases the volume of the foam supplying path at a specific moment in time when generation of the foam by the foam generation unit is being stopped, and wherein when the supply of the foam to the application unit is being stopped, the unit that increases the volume of the foam supplying path cause the foam to travel in a direction that the foam does not travel during foam supply operation.

* * * * *